US007984976B2

(12) United States Patent
Tomizawa et al.

(10) Patent No.: US 7,984,976 B2
(45) Date of Patent: Jul. 26, 2011

(54) LIQUID RECORDING HEAD

(75) Inventors: Keiji Tomizawa, Yokohama (JP); Ken Tsuchii, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/637,201

(22) Filed: Dec. 14, 2009

(65) Prior Publication Data

US 2010/0091067 A1 Apr. 15, 2010

Related U.S. Application Data

(62) Division of application No. 11/680,890, filed on Mar. 1, 2007, now Pat. No. 7,654,648.

(30) Foreign Application Priority Data

Mar. 2, 2006 (JP) ..... 2006-056223

(51) Int. Cl.
*B41J 2/05* (2006.01)

(52) U.S. Cl. ..... 347/65

(58) Field of Classification Search ..... 347/40, 347/54, 56, 65
See application file for complete search history.

(56) References Cited

U.S. PATENT DOCUMENTS 6,637,865 B1 10/2003 Murakami et al.
6,652,079 B2 11/2003 Tsuchii et al.
6,830,317 B2 12/2004 Tsuchii et al.
6,976,748 B2 12/2005 Yabe et al.
6,984,025 B2 1/2006 Kaneko et al.
7,077,503 B2 7/2006 Kaneko et al.
7,178,899 B2 2/2007 Silverbrook
7,641,317 B2 * 1/2010 Matsui et al. ..... 347/65
2004/0218007 A1 11/2004 Tomizawa et al.
2007/0035580 A1 2/2007 Ide et al.

* cited by examiner

*Primary Examiner* — An H Do

(74) *Attorney, Agent, or Firm* — Fitzpatrick, Cella, Harper & Scinto

(57) ABSTRACT

A liquid recording head includes an element substrate on which ejection energy generating elements for generating energy for ejecting droplets of liquid are provided in a staggered arrangement, ejection outlets provided opposed to the ejection energy generating elements, ejection energy generation chambers enclosing the ejection energy generating elements, and a flow path constituting member constituting first and second nozzles for supplying the liquid into the ejection energy generation chambers. The second nozzles have flow path lengths shorter than those of the first nozzles, the first and second nozzles are arranged alternately, and an average height of the paths of the first nozzles is greater than that of the paths of the second nozzles.

6 Claims, 8 Drawing Sheets

(A)

(B)

LIQUID RECORDING HEAD

FIELD OF THE INVENTION AND RELATED ART

The present invention relates to a liquid recording head employed by a liquid recording apparatus which records by forming liquid droplets by jetting liquid.

An ink jet recording method is one of the so-called nonimpact recording methods.

Referring to FIGS. 8, (A) and 8, (B), which are schematic drawings of the typical ink jet recording apparatus in accordance with the prior art, which is disclosed in U.S. Pat. No. 6,637,865, the typical ink jet recording head in accordance with the prior art (which hereafter will be referred to as conventional ink jet recording head) has a substrate 101 and multiple heaters 102. Each heater 102 is an electrothermal transducing element as the element for generating the energy for jetting ink, and is placed on the substrate 101. The recording head also has a flat orifice layer 103 (liquid passage layer), which is placed on the substrate 101. This layer 103 has multiple bubble generation chambers 104, multiple individual ink delivery passages 106, and multiple nozzles 107. Each bubble generation chamber 104 is a chamber in which the energy for jetting ink is generated, and in which the heater 102 is located. Each ink delivery passage 106 delivers ink to the corresponding nozzle 107 from a common ink delivery chamber 105, which is a hole, with which the substrate 101 is provided for delivering ink to each nozzle 107. Each nozzle 107 includes an ink jetting hole portion 109, through which the ink in the bubble generation chamber 104 is jetted out in a preset direction. Incidentally, in this specification, the portion of the ink jet recording head, which includes the bubble generation chamber 104, an actual ink jetting hole 108, and the portions in-between, will be referred to as ink jetting hole portion 109.

In order to improve an ink jet recording head, such as the above described one, in the resolution with which a print is yielded, it is necessary to reduce the size of a dot formed on print medium by each liquid droplet, and in order to reduce the dot size, it is necessary to reduce the liquid droplet size. However, the reduction in the liquid droplet size requires the number of liquid droplets which must be jetted per unit length of time onto recording medium such as paper to be increased. Otherwise, throughput will reduce. Thus, the present invention is related to a means for increasing the nozzle count as one of the means for increasing the number of liquid droplets which can be jetted per unit length of time.

In order to increase nozzle count without changing nozzle pitch, a recording head chip must be increased in size, which adds to the cost of a recording head chip. Therefore, in order to increase nozzle count, nozzles must be placed in a higher density. However, placing heaters in a straight line at a higher density, that is, with a smaller pitch, requires the partitioning wall between the bubble generation chambers of the adjacent two nozzles to be reduced in thickness. The reduction in thickness of the partitioning walls reduces the adhesion between the substrate, and the layer having the partitioning walls, which is problematic in that the layer having the ink passages might peel away from the substrate, or the like problem will occur.

Thus, the inventors of the present invention studied the possibility of increasing the nozzle count of an ink jet recording head without reducing the thickness of the partitioning wall between the bubble generation chambers of the adjacent two ink jetting portions, by arranging heaters in a zigzag pattern. More specifically, with the heaters arranged in a zigzag pattern, the adjacent two nozzles are rendered different in length; one of the two nozzles is rendered longer (which hereafter will be referred to as long nozzle) in the ink delivery passage portion than the other nozzle (which hereafter will be referred to as short nozzle). Further, the portion of the long nozzle, which is adjacent to the bubble generation chamber of the short nozzle is reduced in width. With the employment of this structural arrangement, even when the nozzles were arranged with a smaller pitch, it was possible to provide the wall between the bubble generation chamber and the long nozzle with a substantial thickness, and therefore, it was possible to ensure that the substrate and ink delivery passage layer remain tightly adhered to each other.

However, the long nozzle and short nozzle are very different in characteristic in terms of the manner in which ink is jetted, and reliability. For example, according to the prior art, the long nozzle and short nozzle are different in the ink delivery passage length, but are the same in the ink delivery passage height. Therefore, the former is greater in the friction between the body of liquid in the ink delivery passage and the wall of the ink delivery passage (which hereafter will be referred to simply as flow resistance), being therefore slower to refill than the latter. Therefore, the long and short nozzles are different in refill frequency. If two nozzles different in refill frequency are driven at the same liquid jetting frequency, the meniscus in one nozzle behaves differently from that in the other nozzle. Therefore, the two nozzles become different in the amount by which liquid is jetted, and the velocity with which liquid is ejected, which results in the formation of an image which is nonuniform in density, and also, the deviation in the liquid droplet landing spot. In the past, these problem were dealt with by reducing the width of the ink delivery passage of the shorter nozzle to make the liquid flow resistance of the shorter nozzle as close as possible to that of the longer nozzle to equalize the long and short nozzle in refill characteristic (frequency) (FIGS. 9, (A) 9, (D)). In other words, the frequency with which an ink jet recording head jets ink was reduced by being affected by the liquid ejection characteristic of the longer nozzle.

FIG. 9, (A) is a phantom plan view of the portion of the conventional ink jet recording head, in which a combination of adjacent two nozzles, that is, the long and short nozzles, among the multiple nozzles are located, as seen from the direction perpendicular to the substrate. FIG. 9, (B) is a vertical sectional view of the portion of the ink jet recording head, shown in FIG. 9, (A), at a line A-A' in FIG. 9, (A), and FIG. 9, (C) is a vertical sectional view of the portion of the ink jet recording head, shown in FIG. 9, (A), at a line B-B' in FIG. 9, (A). FIG. 9, (D) is a vertical sectional view of the portion of the ink jet recording head, shown in FIG. 9, (A), at a line C-C' in FIG. 9, (A). Designated with reference numerals 201, 202, and 203 in these drawings are a heater, an ink jetting opening, and a bubble generation chamber, respectively. Designated with reference numerals 204, 205*a*, 205*b*, and 206 are a hole which connects the ink jetting opening to the bubble generation chamber, the ink delivery passage of the shorter nozzle, the ink delivery passage of the longer nozzle, and a columnar filter, respectively. Incidentally, if the entirety of the above described conventional ink jet recording head shown in FIGS. 9, (A)-9, (D) is seen from the same directions as the ink jet recording head is seen in FIG. 8, it will appear as if the two straight columns of heaters 102, shown in FIG. 8, arranged in a manner of sandwiching the common ink delivery chamber 5, and the actual ink jetting openings 8, shown in FIG. 8, which correspond in position to the heaters 102, one for one, were rearranged in a zigzag pattern.

Generally, the liquid components in the body of a given nozzle evaporate through the ink jetting opening, increasing thereby the body of ink in viscosity. Thus, if the body of ink in a given nozzle is not refreshed (by being suctioned out in recovery operation and/or preparatory ink jetting operation) for a while, the nozzle sometimes fails to jet ink, becomes slower in ink jetting velocity, and/or becomes deviant in ink droplet landing spot. This phenomenon is rectified to a certain degree by the natural transfusion of the liquid components in the body of ink supplied from the ink delivery passage, into the nozzle. However, the employment of the conventional structural arrangement makes both the ink delivery passage of a long nozzle and the ink delivery passage of a short nozzle larger in flow resistance (because ink jetting characteristic of short nozzle is matched to that of long nozzle). Therefore, it exacerbates the abovementioned problems, reducing, therefore, an ink jet recording head in reliability in terms of ink jetting performance.

SUMMARY OF THE INVENTION

The present invention was made in consideration of the above described actual problem, and the primary object of the present invention is to provide an ink jet recording apparatus which is capable of recording at a substantially higher level of resolution than a conventional ink jet recording apparatus, and yet, is superior in ink jetting characteristic and reliability, by providing a structural design for an ink jet recording head, which allows the wall between the bubble generation chamber of a short nozzle and the ink delivery passage of the adjacent long nozzle, to be virtually unchanged in thickness in spite of the decrease in the nozzle pitch.

According to an aspect of the present invention, there is provided a liquid recording head comprising an element substrate on which ejection energy generating elements for generating energy for ejecting droplets of liquid are provided in a staggered arrangement; ejection outlets provided opposed to said ejection energy generating elements; ejection energy generation chambers enclosing said ejection energy generating elements; and a flow path constituting member constituting first and second nozzles for supplying the liquid into said ejection energy generation chamber, wherein said second nozzles have flow path lengths shorter than those of said first nozzle, and said first and second nozzles are arranged alternately, wherein an average height of the path of said first nozzles is larger than that of said second nozzles.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings. In the following preferred embodiments, the heater as an element for generating the energy for jetting liquid is an electrothermal transducing element. However, the present invention is also compatible with an ink jet recording head which employs a piezoelectric element or the like.

Embodiment 1

Figure 1:
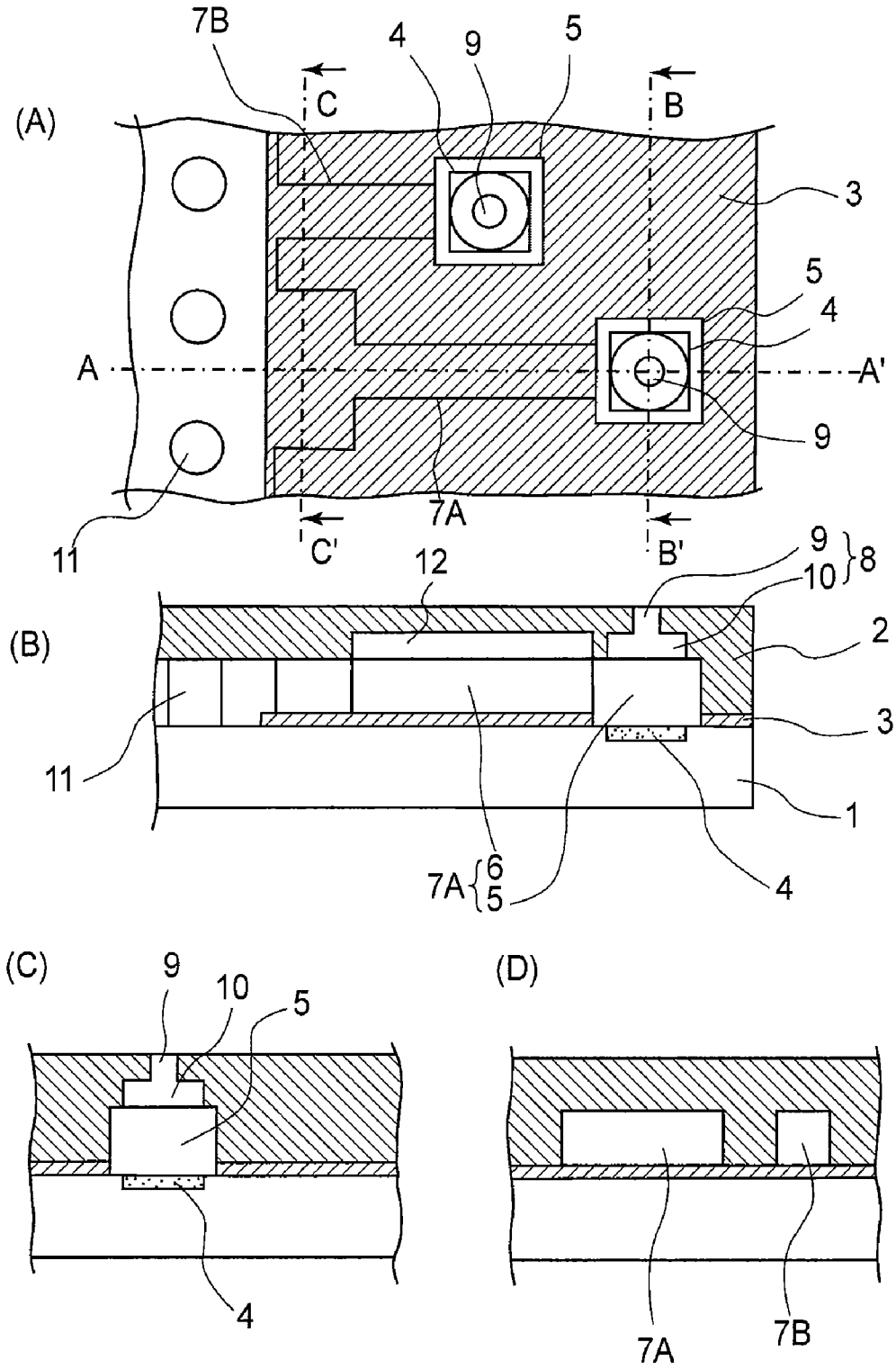
FIG. 1 comprises schematic drawings showing the nozzle structure of the ink jet recording head in the first embodiment.

FIG. 1 ((A)-(D)) shows the nozzle structure of the ink jet recording head in the first preferred embodiment of the present invention. In FIG. 1, (A) is a phantom plan view of a portion of the ink jet recording head, in which the adjacent two nozzles, more specifically, the adjacent long and short nozzles, among the multiple nozzles of the ink jet recording head, are located, as seen from the direction perpendicular to the substrate of the ink jet recording head. In FIG. 1, (B) is a sectional view of the portion of the ink jet recording head, shown in FIG. 1, (A), at a line A-A' in FIG. 1, (A), and FIG. 1, (C) is a sectional view of the portion of the ink jet recording head, shown in FIG. 1, (A), at a line B-B' in FIG. 1, (A). FIG. 1, (D) is a sectional view of the portion of the ink jet recording head, shown in FIG. 1, (A), at a line C-C' in FIG. 1, (A).

Figure 8:
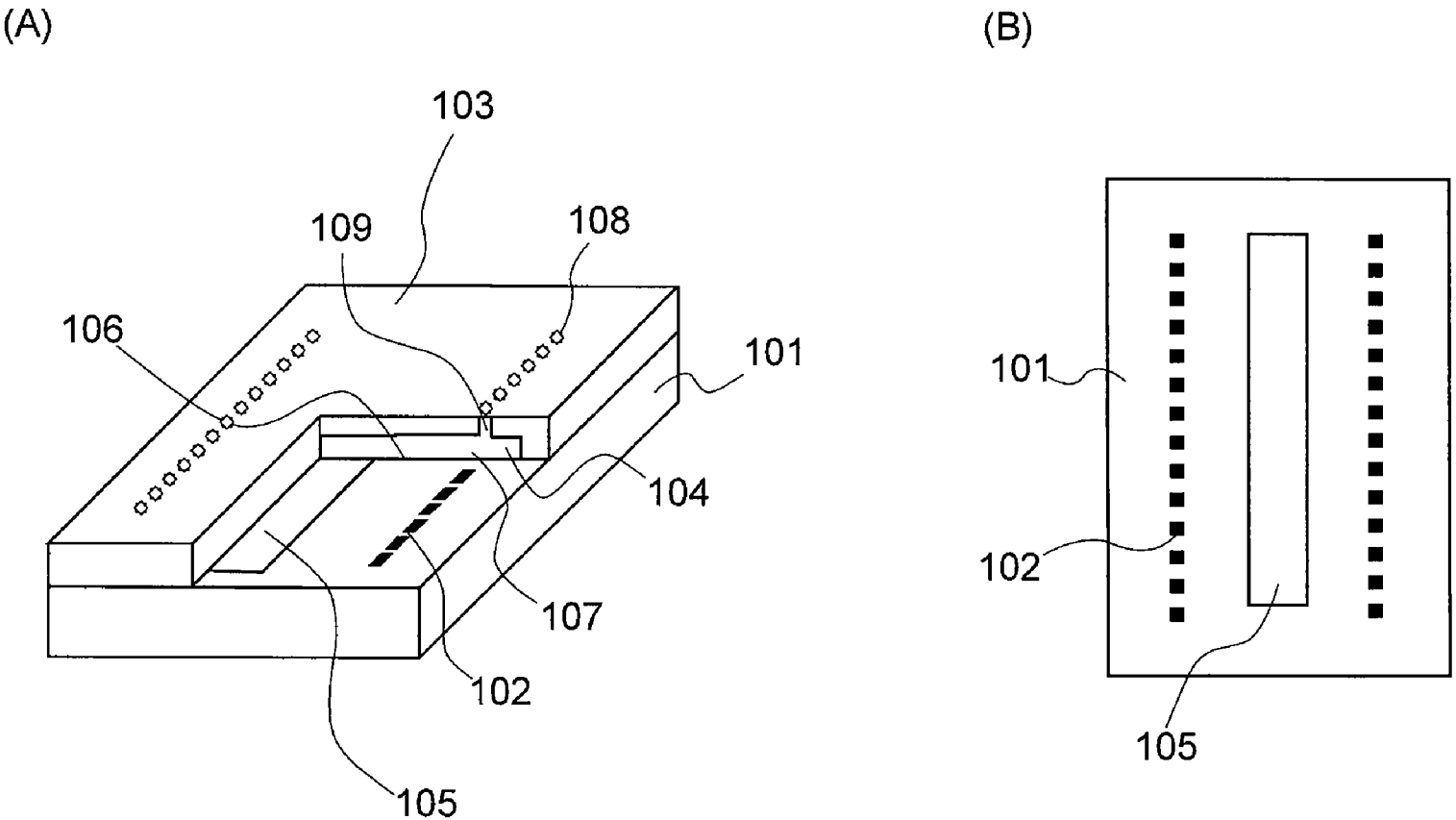
FIG. 8 comprises schematic drawings of a typical ink jet recording head in accordance with the prior art.
Figure 9:
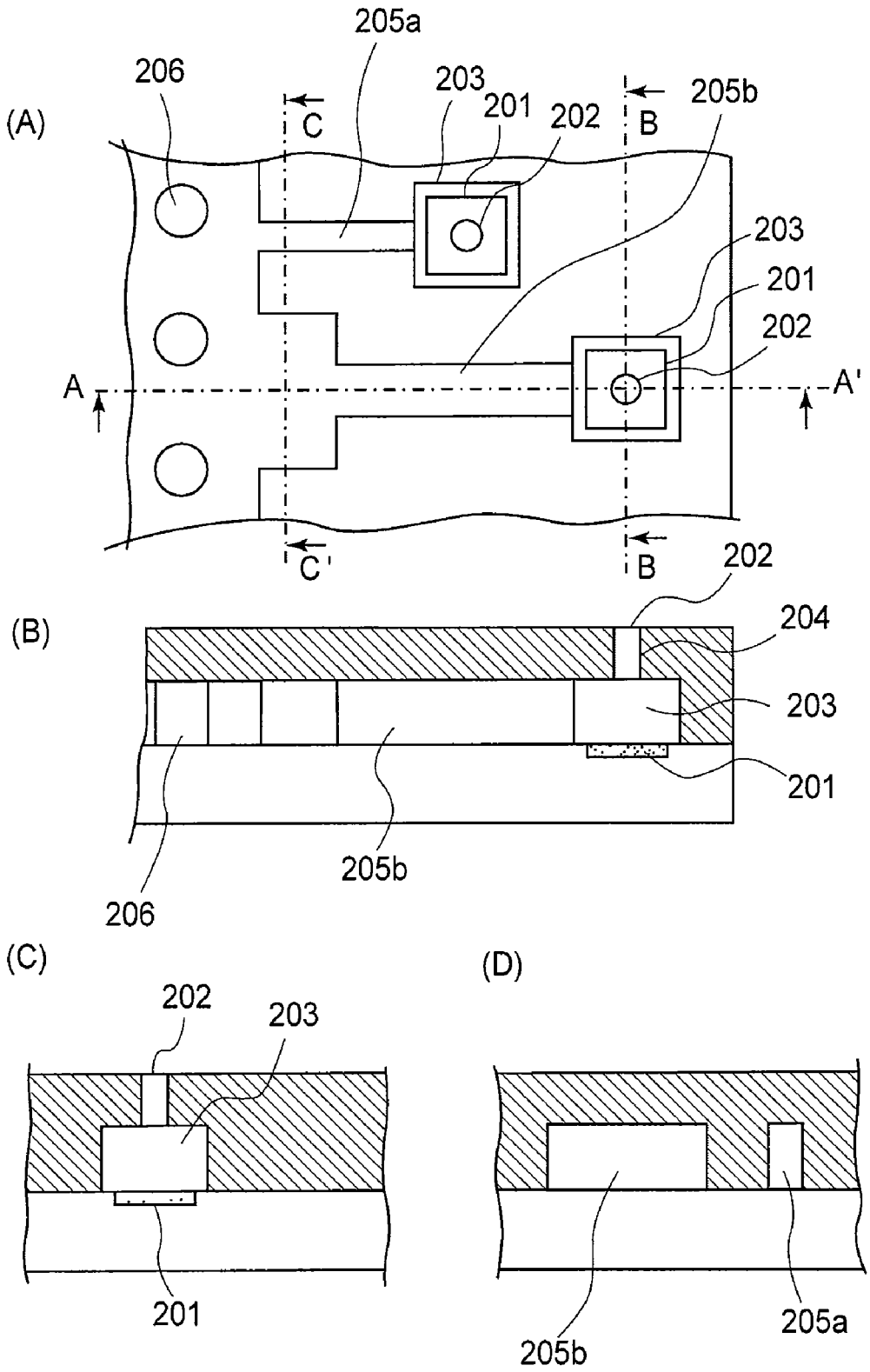
FIG. 9 comprises schematic drawings of a typical ink jet recording head in accordance with the prior art, showing the nozzle structure which suffers from the problems which the present invention can solve.

The ink jet recording head shown in FIG. 1 is made up of a substrate 1, a liquid passage containing layer 2 (orifice containing layer), and a close-contactness improving layer (adhesion improvement layer} 3. The ink passage containing layer 2 (which hereafter will be referred to as ink passage layer 2) and adhesion improvement layer are adhered in layers in the listed order. The ink jet recording head also has multiple heaters 4, which are the elements for generating the thermal energy for jetting liquid, and are arranged on the top surface of the substrate in a zigzag pattern. The liquid passage containing member 2 has: bubble generation chambers 5, as the chambers in which the liquid jetting energy is generated, and each of which contains one of the heaters 4; multiple ink delivery passages 6 which deliver ink to the bubble generation chambers 5, and multiple ink jetting hole portions 8 for jetting ink from the bubble generating chamber 5 in the direction perpendicular to the substrate 1. The bubble generation chamber 5 and ink delivery passage 6 make up a nozzle 7. That is, the ink jet recording head has multiple nozzles 7 made up of the ink delivery passage 6 and bubble generation chamber 5. There are two kinds of nozzles 7, that is, nozzles 7A and nozzles 7B. In other words, if the entirety of the above described conventional ink jet recording head in this embodiment is seen from the same directions as the ink jet recording head is seen in FIG. 8, it will appear as if the two straight columns of heaters 102, shown in FIG. 8, arranged in a manner of sandwiching the common ink delivery chamber 105, and the actual ink jetting openings 8, shown in FIG. 8, which correspond in position to the heaters 102, one for one, were rearranged in a zigzag pattern.

Referring to FIG. 1, (A), the heaters 4 are arranged in a zigzag pattern, the nozzles 7 are arranged so that the long nozzles 7A, or the nozzles 7 whose ink delivery passage 6 is longer, and the short nozzles 7B, or the nozzles 7 whose ink delivery passage 6 is shorter, are alternately positioned in terms of the lengthwise direction of the substrate 1.

The common ink delivery chamber 105 is provided with multiple columnar filters 11, each of which is located near the entrance of the corresponding ink delivery passage 6.

The adhesion improvement layer 3 in this embodiment covers the top surface of the substrate 1, except for the areas which correspond to the bubble generation chambers 5.

The ink jetting hole portion 8 is the portion between the bubble generation chamber 5 and an ink jetting hole 9, that is, the outward end portion of the ink jetting hole portion 8, through which ink droplets are jetted out of the ink jet recording head. This ink jetting hole portion 8 has an intermediary chamber 10, which is located between the bubble generation chamber 5 and ink jetting hole 9, and which is greater in diameter than that of the ink jetting hole 9.

The present invention is characterized in that the long nozzle 7A is greater in the average height of the ink supply passage 6 than the short nozzle 7B. Here, the average height of the ink delivery passage 6 means the average dimension of the ink delivery passage 6, in terms of its height direction, between the entrance of the ink delivery passage 6 and the upstream end of the bubble generation chamber 5 in terms of the ink delivery direction.

Referring to FIGS. 1, (A) and 1, (B), the smallest portion (in terms of width) of the ink delivery passage 6 of the long nozzle 7A of the ink jet recording head in this embodiment (which hereafter will be referred to as narrowest portion) is greater in cross section than that of a conventional ink jet recording head. This was achieved by expanding upward the narrowest portion of the ink delivery passage 6; the ceiling of the narrowest portion of the ink delivery passage 6 was raised to provide the narrowest portion of the ink delivery passage with an additional space 12, which corresponds to an intermediary layer which will be described later. That is, in order to increase the narrowest portion of the ink delivery passage 6 in cross section, the narrowest portion of the ink delivery passage 6 of the long nozzle 7A was rendered taller by removing the portion of the ink passage layer 2, which corresponds to the ceiling of the narrowest portion of the ink delivery passage 6, by a preset amount. However, the portion of the ink delivery passage 6 of the long nozzle 7A, which is not rendered taller, is the same in height as the ink delivery passage 6 of the short nozzle 7B (FIG. 1, (D)). Incidentally, the narrowest portion of the ink delivery passage 6 of the long nozzle 7A roughly lines up with the bubble generation chamber 5 of the adjacent short nozzle 7B in terms of the lengthwise direction of the substrate 1.

The employment of the above described structural arrangement makes the ink delivery passage 6 of the long nozzle 7A closer in flow resistance to the ink delivery passage 6 of the short nozzle 7B, making it therefore possible to roughly equalize the long and short nozzles 7A and 7B in liquid jetting characteristic, without sacrificing the short nozzle 7B in terms of refill frequency. At the same time, it reduces both the long and short nozzles in flow resistance compared to those in accordance with the prior art, making it possible to prevent the ink jetting hole portion 8 from being reduced in ink jetting performance, preventing thereby both the long and short nozzles from being reduced in reliability in terms of ink jetting performance. Needless to say, the employment of the above described structural arrangement mitigates the problem that the reduction in thickness of the wall between the short nozzle 7B and long nozzle 7A weakens the adhesion between the substrate 1 and ink passage layer 2. In other words, the above described structural arrangement is very useful as a countermeasure for the above described problems from which the prior art suffers.

Figure 2:
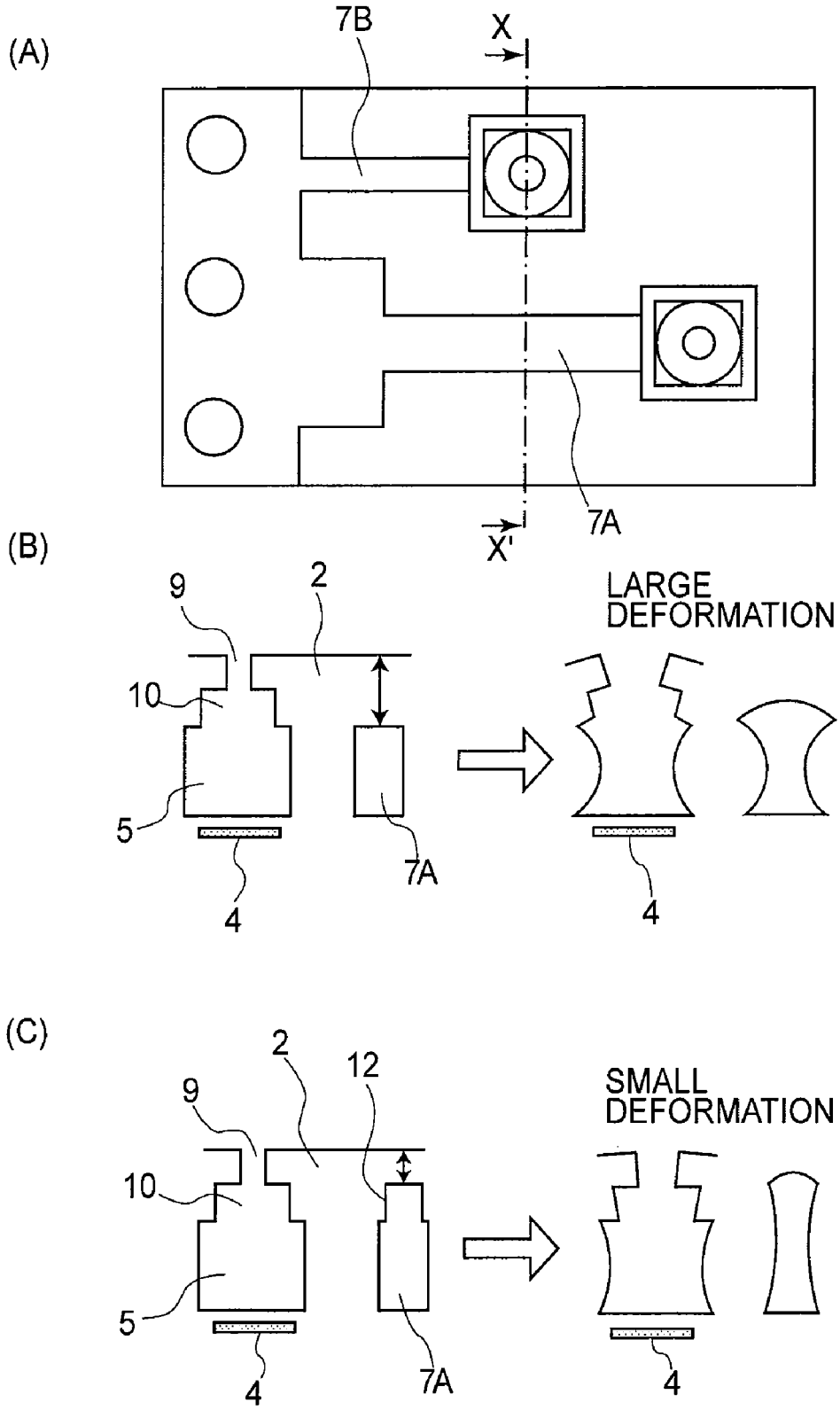
FIG. 2 comprises schematic drawings for describing one of the effects of the nozzle structure in the first embodiment.

One of the methods for reducing an ink jet recording head in the size of the ink droplet it jets is to reduce the diameter of its ink jetting opening. However, reducing the diameter of the ink jetting opening increases the flow resistance of the ink jetting holes, reducing thereby the velocity (jetting efficiency) with which ink is jetted from the ink jet recording head, which is problematic. In order to prevent this problem, the ink jetting hole portion 8 of the ink jet recording head in this embodiment is provided with the intermediary ink chamber 10 to increase in diameter of a part of the ink jetting hole portion 8 to reduce the ink jetting hole portion 8 in flow resistance in terms of the ink jetting direction. However, this structural arrangement results in the thinning of the portions of the ink passage layer 2, which correspond to the ink jetting hole 9. This is problematic for the following reason. That is, the stress attributable to the expansion (caused, for example, by refilling of ink jet recording head with ink) of the material for the ink passage layer 2 tends to concentrate in the adjacencies of the ink jetting hole 9, possibly causing the ink jetting hole portion 8 to deform. The deformation of the jetting hole portion 8 results in the problem that the ink droplets jetted from the ink jet recording head fail to land on correct spots, and/or the ink jet recording head becomes unstable in the amount by which it jets ink each time (FIG. 2, (B)). In the case of the structural arrangement in this embodiment, however, each short nozzle 7B is flanked, on both sides, by the ink delivery passages 6 of the adjacent two long nozzles 7A, one for one, the ceilings of which are level with the ceiling of the intermediary chamber 10 of the ink jetting hole portion 8. Therefore, the abovementioned stress is released into these portions of the ink delivery passages 6, lessening the amount by which the ink jetting hole 9 of the short nozzle 7B is deformed (FIG. 2, (C)). FIG. 2, (C) is a sectional view of the ink jet recording head, at a line X-X' in FIG. 2, (A). It shows the structural arrangement in which the ceiling of the ink delivery passage 6 of the long nozzle 7A is rendered level with the ceiling of the intermediary chamber 10. Therefore, this structural arrangement is effective to mitigate the deviation in terms of the landing spot of the ink droplet jetted from the ink jetting hole 9 connected to the short nozzle 7B, and also, the fluctuation in the amount by which ink is jetted from the ink jetting hole 9 connected to the short nozzle 7B. These effects are realized because the portion of the ink passage layer 2, which corresponds to the higher ceiling portion of the ink delivery passage 6 of the long nozzle 7A, is roughly the same in thickness as the portion of the ink passage layer 2, which corresponds to the ink jetting hole 9, or thinner.

Incidentally, FIG. 2, (A) is a phantom plan view of one of the areas of the ink jet recording head, which includes one of the multiple long nozzles and the adjacent short nozzle, as seen from the direction perpendicular to the substrate 1. FIG. 2, (B) is a sectional view of the portion of the ink jet recording head, shown in FIG. 2, (A), at a line X-X' in FIG. 2, (A). It shows how the ink passage layer 2, in which the ceiling of the ink delivery passage 6 of the long nozzle 7A is level with the ceiling of the bubble generation chamber 5 of the short nozzle 7B, deforms as the material for the ink passage layer 2 expands. FIG. 2, (C) is a sectional view of the portion of the ink jet recording head, shown in FIG. 2, (A), at a line X-X' in FIG. 2, (A). It shows how the ink passage layer 2, in which the ceiling of the ink delivery passage 6 of the long nozzle 7A (ceiling has been raised) is level with the ceiling of the intermediary chamber 10 of the short nozzle 7B, deforms as the material for the ink passage layer 2 expands.

Embodiment 2

Figure 3:
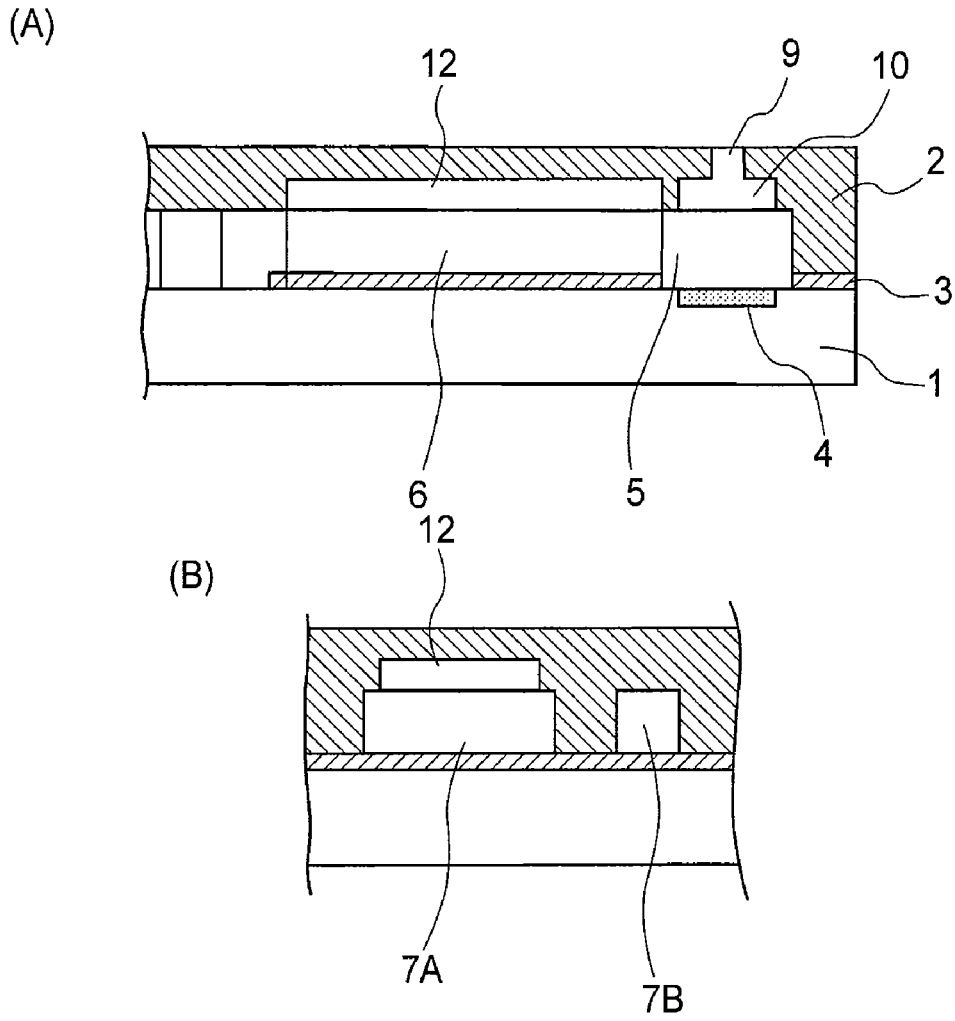
FIG. 3 comprises schematic drawings showing the nozzle structure of the ink jet recording head in the second embodiment of the present invention.

FIGS. 3, (A) and 3, (B) show the nozzle structure of the ink jet recording apparatus in the second preferred embodiment of the present invention.

The phantom plan view of one of the areas of the ink jet recording head in this embodiment, which includes one of the multiple long nozzles and the adjacent short nozzle, as seen from the direction perpendicular to the substrate 1, is identical to FIG. 1, (A). Further, the sectional view of the portion of the ink jet recording apparatus in this embodiment, which corresponds to the line B-B' in FIG. 1, (A), is identical to FIG. 1, (C). This embodiment is different from the first embodiment in that the portion of the ink jet recording head in this embodiment, which is shown in FIGS. 3, (A) and 3, (B), which are sectional views of the ink jet recording head in this embodiment, equivalent to FIGS. 1, (B) and 1, (C), is different in structure from the portion of the ink jet recording head in the first embodiment shown in FIG. 1. Incidentally, the structural elements of the ink jet recording head in this embodiment, which are identical to those in the first embodiment are given the same referential characters as those given to the corresponding structural elements in the first embodiment.

Referring to FIGS. 3, (A) and 3, (B), in this embodiment, the entire range of the ink delivery passage 6 of the long nozzle 7A is greater in cross section; it was increased in cross section by the provision of an additional space 12 (which corresponds to an intermediary layer, which will be described later). That is, the entire range of the ink delivery passage 6 of the long nozzle 7A was increased in cross section 12 by increasing its dimension in height direction by removing the portion of the ink passage layer, which corresponds to the abovementioned additional space 12.

The employment of this structural arrangement further reduces the flow resistance of the ink delivery passage 6 of the long nozzle 7A, being therefore advantageous from the standpoint of improving the long nozzle 7A in ink jetting frequency, and preventing the ink jetting hole portion 8 from increasing in the flow resistance.

Embodiment 3

Figure 4:
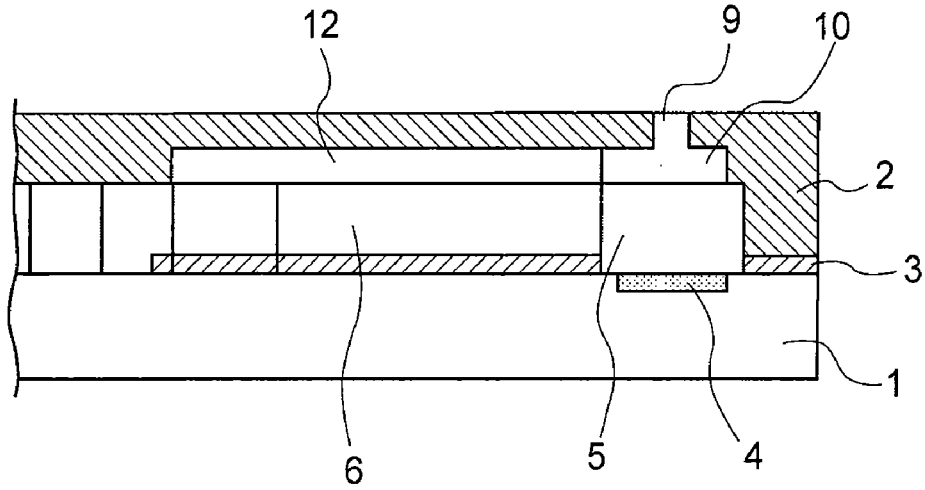
FIG. 4 is a sectional view of one of the nozzles of the ink jet recording apparatus in the third embodiment of the present invention, and its adjacencies, showing the structure thereof.

FIG. 4 shows the nozzle structure of the ink jet recording head in the third embodiment of the present invention.

The phantom plan view of one of the areas of the ink jet recording head in this embodiment, which includes one of the multiple long nozzles and the adjacent short nozzle, as seen from the direction perpendicular to the substrate 1, is identical to FIG. 1, (A). Further, the sectional view of the portion of the ink jet recording apparatus in this embodiment, at a line corresponding to the line B-B' in FIG. 1, (A), is identical to FIG. 1, (C). Further, the sectional view of the portion of the ink jet recording apparatus in this embodiment, at a line corresponding to the line C-C' in FIG. 1, (A), is identical to FIG. 3, (B), which is related to the second embodiment.

What makes this embodiment different from the first and second embodiments is the structure of the portion of the ink jet recording head shown in FIG. 4, which is the sectional view of the abovementioned portion of the ink jet recording head in this embodiment, at the line corresponding to the line A-A' in FIG. 1, (A). Incidentally, the structural elements of the ink jet recording head in this embodiment, which are identical to those in the first and second embodiments are given the same referential characters as those given to the corresponding structural elements in the first and second embodiments.

Referring to FIG. 4, the ceiling of the entirety of the ink delivery passage 6 of each long nozzle 7A of the ink jet recording head in this embodiment has been raised by providing the ink delivery passage 6 with an additional space 12, which is formed by carving (etching) out by a preset amount, the entirety of the portion of the ink passage layer 2, which was above the former ceiling of the ink delivery passage 6; the ink delivery passage 6 of the long nozzle 7A is increased in cross section in terms of its height direction. In addition, in this embodiment, the ceiling of the ink delivery passage 6, that is, the ceiling of the additional space 12, is rendered continuous and level with the ceiling of the intermediary chamber 10 of the ink jetting hole portion 8.

The employment of this structural arrangement further reduces the flow resistance of the ink delivery passage 6 of the long nozzle 7A, being therefore advantageous from the standpoint of improving the long nozzle 7A in ink jetting frequency, and preventing the ink jetting hole portion 8 from increasing in flow resistance.

Embodiment 4

Figure 5:
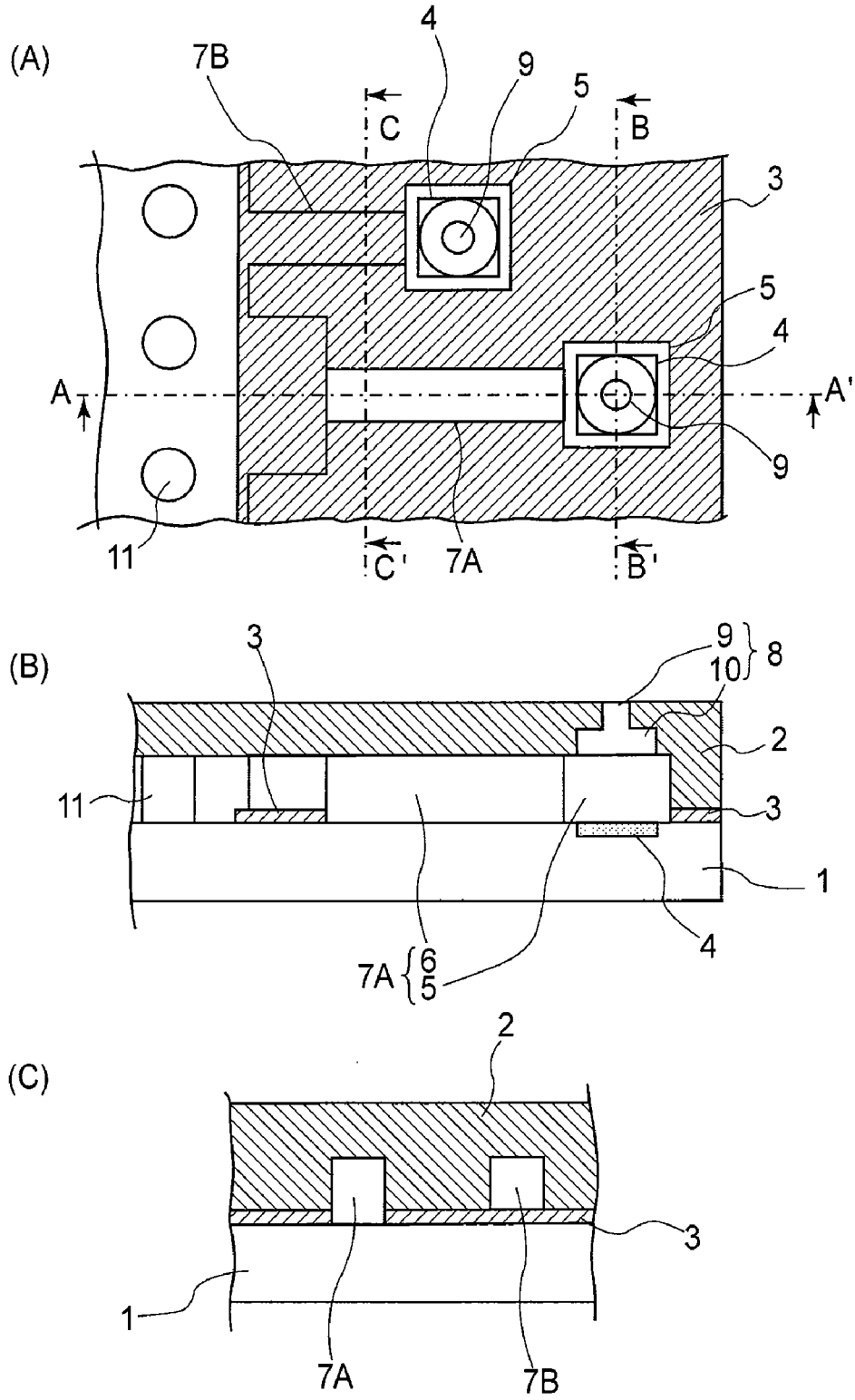
FIG. 5 comprises schematic drawings of the adjacent long and short ink jetting portions of the ink jet recording head in the fourth embodiment of the present invention, showing the nozzle structures thereof.

FIGS. 5, (A)-5, (C) show the nozzle structure of the ink jet recording head in the fourth embodiment of the present invention. FIG. 5, (A) is a phantom plan view of a portion of the ink jet recording head, in which the adjacent two nozzles, more specifically, one of the long nozzles and the adjacent short nozzle, among the multiple nozzles of the ink jet recording head, are located, as seen from the direction perpendicular to the substrate of the ink jet recording head. FIG. 5, (B) is a sectional view of the portion of the ink jet recording head, shown in FIG. 5, (A), at a line A-A' in FIG. 5, (A), showing the characteristic feature of the nozzle structure of the ink jet recording head in this embodiment, and FIG. 5, (C) is a sectional view of the portion of the ink jet recording head, shown in FIG. 5, (A), at a line C-C' in FIG. 5, (A), showing also the characteristic features of the nozzle structure of the ink jet recording head in this embodiment. Incidentally, the structural elements of the ink jet recording head in this embodiment, which are identical to those in the preceding embodiments are given the same referential characters as those given to the corresponding structural elements in the preceding embodiments.

In each of the preceding embodiments described above, the adhesion improvement layer 3 for improving the ink jet recording head in terms of the adhesion between the substrate 1 and ink passage layer 2 covers practically the entirety of the top surface of the substrate 1, except for the areas corresponding to the bubble generation chambers 5. In this embodiment, however, not only are the areas corresponding to the bubble generation chambers 5 not covered with the adhesion improvement layer 3, but also, the areas corresponding to the narrowest portion of ink delivery passage 6 of each long nozzle 7A, as shown in FIGS. 5, (A)-5, (C). That is, the dimension of the ink delivery passage 6 of each long nozzle 7A, in terms of the height direction, was increased by removing the adhesion improvement layer 3 from the areas of the top surface of the substrate 1 corresponding to the narrowest portion of the ink delivery passage 6 of the long nozzle 7A, in addition to the areas corresponding to the bubble generation chambers 5. Incidentally, the narrowest range of the ink delivery passage 6 of the long nozzle 7A is adjacent to the bubble generation chamber 5 of the adjacent short nozzle 7B.

The employment of this structural arrangement increases the dimension of the cross section of the ink delivery passage 6 of the long nozzle 7A in terms of the height direction, making the flow resistance of the ink delivery passage 6 of the long nozzle 7A nearly equal to that of the short nozzle 7B. Thus, it virtually equalizes the long and short nozzles in terms of ink jetting characteristic without sacrificing the short nozzle 7B in refill frequency. At the same time, it reduces in flow resistance both the long and short nozzles, preventing thereby the ink jetting hole portion 8 from increasing in flow resistance, compared to those of an ink jet recording head in accordance with the prior art. Therefore, it can provide an ink jet recording head which is reliable in terms of the ink jetting performance of both the long and short nozzles thereof. Needless to say, it also solves the problem attributable to the prior art, that is, the problem that the employment of the prior art reduces the thickness of the wall between the short nozzle and the adjacent long nozzle, and therefore, reduces the strength of the adhesion between the substrate 1 and ink passage layer 2. In other words, the present invention is very effective to solve the above described problems from which an ink jet recording head in accordance with the prior art suffer.

Embodiment 5

Figure 6:
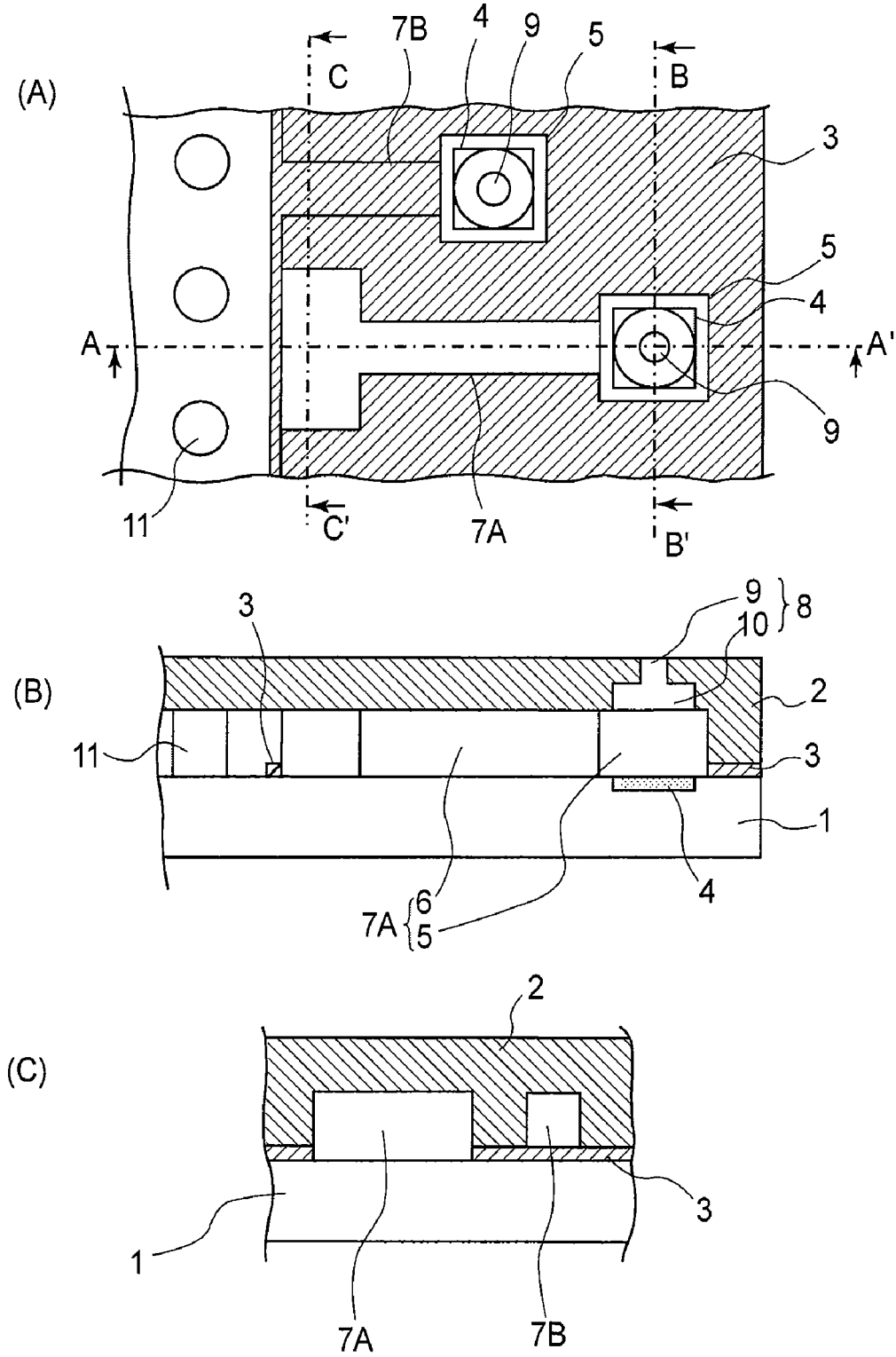
FIG. 6 comprises schematic drawings of the adjacent long and short ink jetting portions of the ink jet recording head in the fifth embodiment of the present invention, showing the nozzle structures thereof.

FIGS. 6, (A)-6, (C) show the nozzle structure of the ink jet recording head in the fifth embodiment of the present invention. FIG. 6, (A) is a phantom plan view of a portion of the ink jet recording head, in which the adjacent two nozzles, more specifically, one of the long nozzles and the adjacent short nozzle, among the multiple nozzles of the ink jet recording head, are located, as seen from the direction perpendicular to the substrate of the ink jet recording head. FIG. 6, (B) is a sectional view of the portion of the ink jet recording head, shown in FIG. 6, (A), at a line A-A' in FIG. 6, (A), showing the characteristic features of the nozzle structure of the ink jet recording head in this embodiment, and FIG. 6, (C) is a sectional view of the portion of the ink jet recording head, shown in FIG. 6, (A), at a line C-C' in FIG. 6, (A), showing also the characteristic features of the nozzle structure of the ink jet recording heat in this embodiment. The structure of the portion of the ink jet recording head, which is shown in FIG. 6, (C), or the sectional view at the line B-B' in FIG. 6, (A), is the same as the structure of the portion of the ink jet recording head in the first embodiment, shown in FIG. 1, (C). Incidentally, the structural elements of the ink jet recording head in this embodiment, which are identical to those in the preceding embodiments are given the same referential characters as those given to the corresponding structural elements in the preceding embodiments.

Referring to FIGS. 6, (A)-6, (C), in this embodiment, not only is the area of the top surface of the substrate 1 corresponding to the bubble generation chamber 5 of each long nozzle 7A not covered with the adhesion improvement layer 3, but also, the area of the top surface of the substrate 1 corresponding to the entire range of the ink delivery passage 6 of each long nozzle 7A. In other words, the ink delivery passage 6 of each long nozzle 7A was increased in cross section by increasing the dimension of the ink delivery passage 6 in terms of its height direction by removing the portions of the adhesion improvement layer 3 corresponding to the entire range of the ink delivery passage 6 of each long nozzle 7A.

The employment of this structural arrangement increases the cross section of the ink delivery passage 6 of each long nozzle 7A by increasing the dimension of the ink delivery passage 6 in terms of the height direction. This embodiment is advantageous over the fourth embodiment in that it further reduces the flow resistance of the ink delivery passage 6 of the long nozzle 7A, being therefore advantageous from the standpoint of improving an ink jet recording head in jetting frequency, and also, preventing the ink jetting hole portion 8 from increasing in flow resistance.

Embodiment 6

Figure 7:
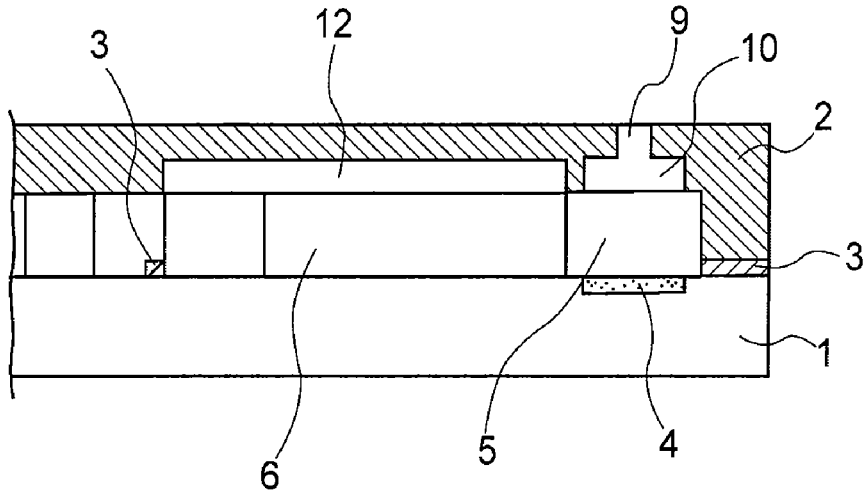
FIG. 7 comprises schematic drawings of the adjacent long and short ink jetting portions of the ink jet recording head in the sixth embodiment of the present invention, showing the nozzle structures thereof.
Figure 7:
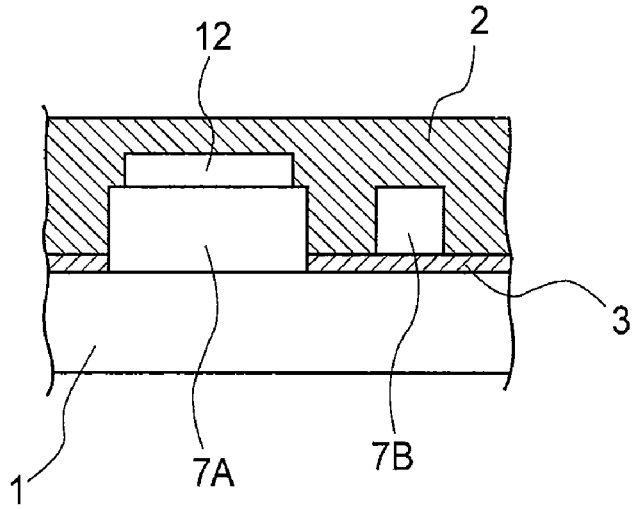

FIGS. 7, (A) and 7, (B) show the nozzle structure of the ink jet recording head in the sixth embodiment of the present invention.

The phantom plan view of the portion of the ink jet recording head, in this embodiment, in which a combination of adjacent two nozzles, more specifically, adjacent long and short nozzles, among the multiple nozzles of the ink jet recording head is located, as seen from the direction perpendicular to the substrate, is identical to FIG. 6, (A). The portion of the ink jet recording head in this embodiment, which corresponds to the portion of the ink jet recording head in the fifth embodiment, shown in FIG. 6, (B), is identical in structure to the portion of the ink jet recording head in the fifth embodiment, shown in FIG. 6, (B), that is, the portion of the ink jet recording head shown in FIG. 1, (C). The sixth embodiment of the present invention is different from the fifth one in that the portion of the ink jet recording head in this embodiment, shown in FIG. 7, (A), is different from the portion of the ink jet recording head in the fifth embodiment, shown 6, (B) which is the sectional view of the portion of the ink jet recording head at the line A-A' in FIG. 6, (A), and also, that the portion of the ink jet recording head in this embodiment, shown in FIG. 7, (B), is different from the portion of the ink jet recording head in the fifth embodiment, shown 6, (C), which is the sectional view of the portion of the ink jet recording head at the line C-C' in FIG. 6, (A). Incidentally, the structural elements of the ink jet recording head in this embodiment, which are identical to those in the preceding embodiments are given the same referential characters as those given to the corresponding structural elements in the preceding embodiments.

Referring to FIGS. 7, (A) and 7, (B), in this embodiment, not only are the area of the top surface of the substrate 1 corresponding to the bubble generation chamber 5 of each long nozzle 7A and the area of the top surface of the substrate 1 corresponding to the entire range of the ink delivery passage 6 of each long nozzle 7A not covered with the adhesion improvement layer 3, but also, the entire range of the ink delivery passage 6 of each long nozzle 7A is increased in cross section by providing the ink delivery passage 6 with an additional space 12. That is, the ink delivery passage 6 of each long nozzle 7A was increased in cross section by increasing the ink delivery passage 6 in the dimension in terms of its height direction by removing the entire portion of the adhesion improvement layer 3, which corresponded to the ink delivery passage 6 and bubble generation chamber of each long nozzle 7A, from the top surface of the substrate 1, and also, removing by a preset thickness, the portion of the ink passage layer 2, which was above the former ceiling of the ink delivery passage 6. In addition, in this embodiment, the additional space 12 of the ink delivery passage 6 is in connection with the intermediary chamber 10 of the ink jetting portion 8.

The employment of this structural arrangement further reduces the flow resistance of the ink delivery passage 6 of each long nozzle 7A, being advantageous from the standpoint of improving an ink jet recording head in terms of ink jetting frequency, and also, preventing the ink jetting opening portion from increasing in flow resistance, compared to those in the first-fifth embodiments.

Miscellaneous Embodiments

The recording head in each of the preceding preferred embodiments of the present invention is manufactured using the following manufacturing method, which comprises: a first step in which multiple heaters 4 are formed on the substrate 1 so that they form zigzag lines; a second step in which a layer for forming ink passages and an intermediary layer are formed on the substrate 1; a third step in which a preset nozzle pattern is formed on the ink passage formation layer, and another preset nozzle pattern is formed on the intermediary layer; a fourth step in which a resin layer is formed in a manner of enclosing on the ink passage layer and intermediary layer; a fifth step in which ink jetting holes 9 are formed through the resin layer; a sixth step in which the common ink delivery channel is cut through the substrate 1; and a seventh step in which the ink passages and intermediary layer are dissolved out. The details of each step are as follows:

The first step is a step for yielding a precursor of an ink jet recording head by forming on the silicon substrate 1, multiple heaters and the wiring for applying voltage to these heaters 4, with the use of a processing method such as patterning. The second step is a step for sequentially layering a coat of a preselected substance for forming ink delivery passages and a coat of another preselected substance for forming the intermediary layer, by spin coating. The substances coated in this step are substances whose molecular bonds can be destroyed by irradiating them with ultraviolet rays so that they can be dissolved. In this step, a resinous substance which can be made to crosslink by dehydrating condensation was used as the material for the intermediary layer, so that when forming the intermediary layer on the ink delivery passage formation layer by spin coating, the intermediary layer and ink delivery passage formation layer are prevented from melting into each other. Incidentally, the patterning of the ink delivery passage formation layer and the patterning the intermediary layer can be independently carried out by using two resins, one for one different in the range of light absorption spectral. The third step is a step for forming a preselected nozzle pattern on the ink delivery passage formation layer. More specifically, in this step, the ink delivery passage formation layer is exposed with the use of an exposing apparatus which emits ultraviolet rays, and is developed. The exposing apparatus used in this step is fitted with a filter which blocks light of specific wavelength in order to expose the ink delivery passage formation layer only with the light of a specific wavelength. The patterns for the long and short nozzles which include ink delivery passages 6 and bubble generation chambers 5 are formed in this step.

The fourth step is a step for forming a preselected nozzle pattern on the intermediary layer by irradiating (exposing) the intermediary layer with the ultraviolet rays emitted by the exposing apparatus, and developing the exposed intermediary layer. More specifically, in this step, the pattern of the part of the ink delivery passage 6 of each long nozzle 7A, and the intermediary chamber 10 of the ink jetting hole portion 8, are formed. The fifth step is a step for coating the ink delivery passage layer and intermediary layer (cross-links in which are destroyable to make them dissolvable) with transparent resin to enclose the two layers with a transparent resin layer. The fifth step is a step for forming the ink jetting holes 9 by removing the portions of the transparent resin layer, which correspond to the ink jetting holes 9, by irradiating the portions with the ultraviolet rays emitted from the exposing apparatus, and developing them. The sixth step is a step for chemically etching the substrate 1 from the back side to form the common ink delivery hole for supplying all the nozzles on the ink jet recording head with ink. The seventh step is a step for irradiating the ink delivery passage formation layer and intermediary layer, which are in the preselected nozzle pattern and are between the substrate 1 and transparent resin layer, with the ultraviolet rays, from the primary surface side of the substrate, through the transparent resin layer, to make the ink delivery passage layer and intermediary layer dissolvable.

It is through the above described steps that an ink jet recording head, such as the ink jet recording head in each of the preceding embodiments, in which the average dimension of the ink delivery passage of each long nozzle 7A, in terms of height direction, is greater than that of each short nozzle 7B, can be obtained.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 056223/2006 filed Mar. 2, 2006, which is hereby incorporated by reference herein.

What is claimed is:

1. A liquid recording head comprising:

an element substrate on which ejection energy generating elements for generating energy for ejecting droplets of liquid are provided in a staggered arrangement;

ejection outlets provided opposed to said ejection energy generating elements;

ejection energy generation chambers enclosing said ejection energy generating elements; and a flow path constituting member constituting first and second supply paths for supplying the liquid into said ejection energy generation chambers, wherein said second supply paths have flow path lengths shorter than those of said first supply paths, said first and second supply paths are arranged alternately, and said first and second supply paths supply liquid into said ejection energy generation chambers in a direction transverse to an ejection direction of the droplets of liquid, wherein an average height of said first supply paths is greater than that of said second supply paths.

2. A liquid recording head according to claim 1, wherein at least a part of said first supply paths has a height greater than that of said second supply paths.

3. A liquid recording head according to claim 2, wherein a small height portion of said first supply paths and a large height portion of said second supply paths have the same height.

4. A liquid recording head according to claim 1, wherein a height of a portion of each of said first supply paths that is adjacent to said ejection energy generation chamber associated with one of said second supply paths is greater than another portion of said first supply paths.

5. A liquid recording head according to claim 1, further comprising a contact improving layer between said element substrate and said flow path constituting member, wherein at least a section where said first flow paths have a smallest width is free of said contact improving layer.

6. A liquid recording head according to claim 5, wherein sections corresponding to an entirety of said first supply paths are free of the contact improving layer.

* * * * *